US007104513B2

(12) United States Patent
Blateri

(10) Patent No.: US 7,104,513 B2
(45) Date of Patent: Sep. 12, 2006

(54) APPARATUS AND METHOD FOR MOUNTING A FIXTURE

(75) Inventor: Frank Blateri, Coppell, TX (US)

(73) Assignee: Diani, LLC., Dallas, TX (US)

( * ) Notice: Subject to any disclaimer, the term of this patent is extended or adjusted under 35 U.S.C. 154(b) by 10 days.

(21) Appl. No.: 10/880,252

(22) Filed: Jun. 29, 2004

(65) Prior Publication Data

US 2005/0285002 A1 Dec. 29, 2005

(51) Int. Cl.
*B42F 13/00* (2006.01)

(52) U.S. Cl. ..... 248/342; 416/244 R

(58) Field of Classification Search ..... 248/317, 248/342, 343, 344; 416/244 R, 246, 5
See application file for complete search history.

(56) References Cited

U.S. PATENT DOCUMENTS

| | | | | |
|---|---|---|---|---|
| 6,305,974 | B1 * | 10/2001 | Tseng | 439/537 |
| 6,311,943 | B1 * | 11/2001 | Tang | 248/343 |
| 6,598,846 | B1 * | 7/2003 | Lackey, Jr. | 248/343 |
| 6,761,540 | B1 * | 7/2004 | Tseng | 416/244 R |
| 6,872,054 | B1 * | 3/2005 | Pearce | 416/244 R |
| 2004/0005218 | A1 * | 1/2004 | Marshall | 416/146 R |
| 2005/0006549 | A1 * | 1/2005 | Liu | 248/343 |
| 2005/0077446 | A1 * | 4/2005 | Bacon et al. | 248/343 |

* cited by examiner

*Primary Examiner*—Ramon O Ramirez
(74) *Attorney, Agent, or Firm*—Haynes and Boone, LLP

(57) ABSTRACT

Apparatus and method for mounting a downrod, and therefore a fixture, to a ceiling, according to which an adapter is disposed in a bore of a hanger ball that is connected to the ceiling, a portion of the downrod is disposed in a bore of the adapter and the downrod is between the hanging ball and the fixture.

4 Claims, 2 Drawing Sheets

APPARATUS AND METHOD FOR MOUNTING A FIXTURE

BACKGROUND

This invention relates to an apparatus for mounting a fixture to a ceiling utilizing a downrod extending between the fixture and the ceiling.

Various ceiling-mountable fixtures, such as fans, lights (semiflushes, chandeliers, pedants, etc,) are usually connected to an electrical box, terminal, or the like, at the ceiling. When it is desired to lower the fixture from the ceiling, a downrod is often connected between the electrical box, or terminal and the fixture. To this end, a hanger ball has been used that is mounted to the ceiling and has an inner bore that receives the upper end portion of the downrod in a manner so that the downrod can be hung from the hanger ball.

The diameter of the bore of the hanger ball should correspond to the outer diameter of the downrod so that the end portion of the downrod can fit in the bore with minimum clearance to insure a stable connection. However, the diameters of the downrods often vary, creating a compatibility problem with the hanger ball, and vice versa.

Therefore, what is needed is an adapter to enable a downrod to be connected to a hanger ball in a stable manner despite variances in the diameter of the downrod and the bore of the hanger ball.

DETAILED DESCRIPTION

Figure 1:
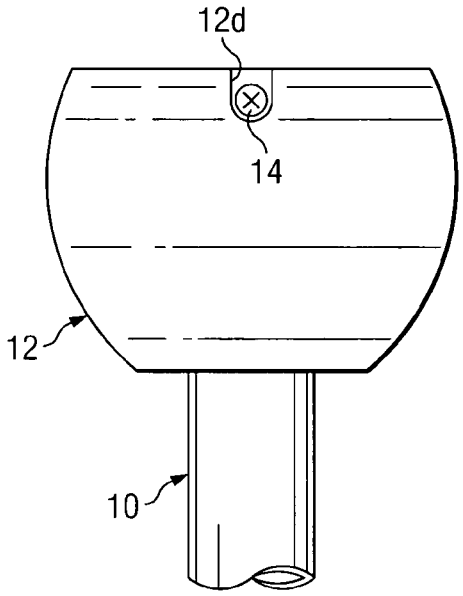
FIG. 1 is an elevational view of an assembly according to an embodiment of the present invention.
Figure 2:
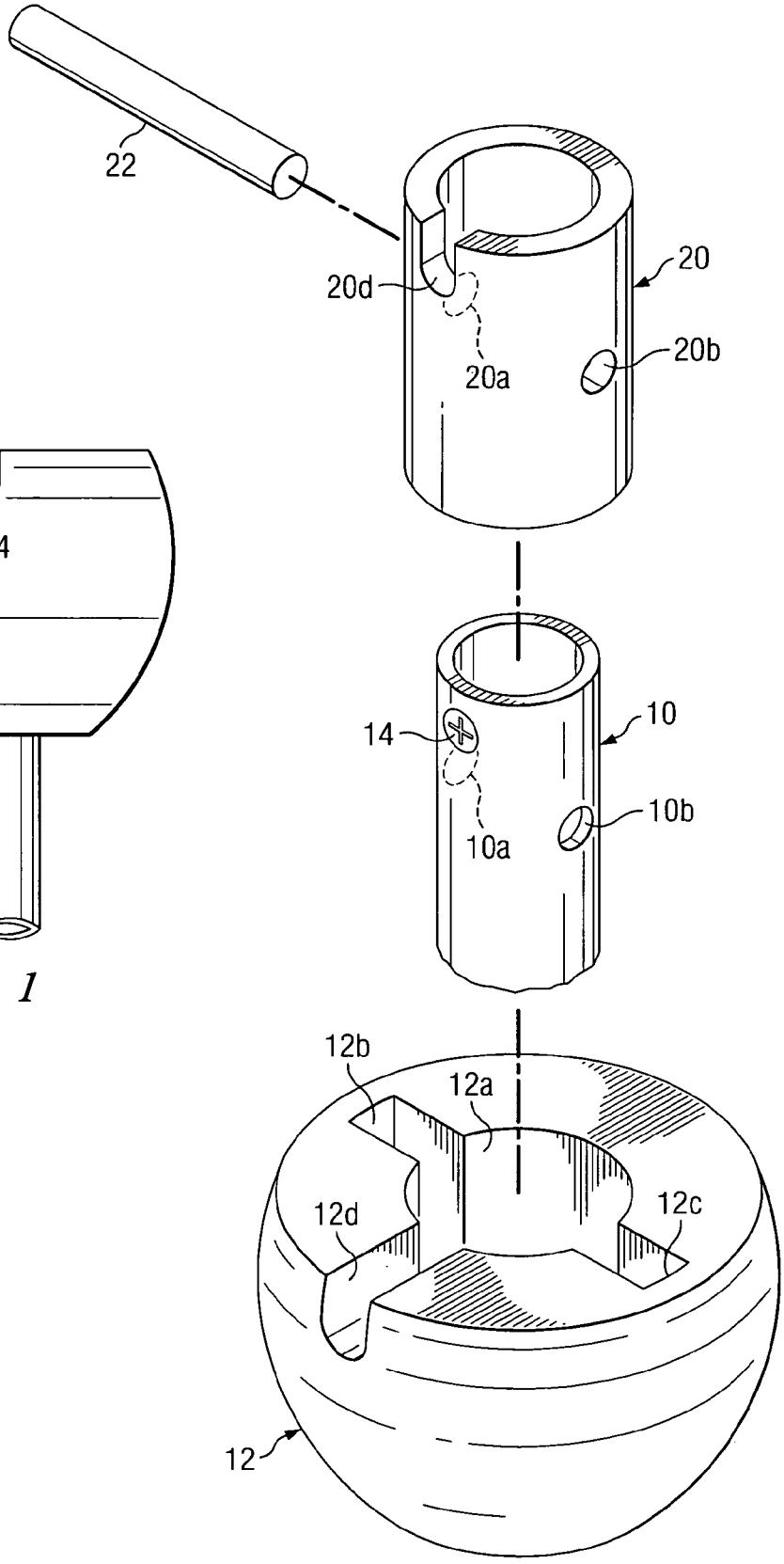
FIG. 2 is an exploded view of the assembly of FIG. 1.

Referring to the drawings, the reference 10 refers, in general, to a downrod having an upper end portion, as viewed in the drawing, extending in, and connected to, a hanger ball 12 in a manner to be explained. It is understood that the hanger ball 12 is designed to be connected to a ceiling via a conventional mounting bracket, or the like not shown). The other end portion of the downrod 10 is adapted for connection, in a conventional manner, to a fixture, such as a ceiling fan, light fixture, or the like, (not shown) in a spaced relation to the ceiling.

The downrod 10 is tubular and has two aligned, diametrically opposed, openings 10*a* and 10*b* (FIG. 3) extending through its wall near its upper end and transverse to the longitudinal axis of the downrod. A ground screw 14 extends through an opening in the upper end portion of the downrod 10 for the purpose of enabling a ground conductor from the ceiling and/or the fixture to be electrically and mechanically connected to the downrod. The remaining electrical conductors from the ceiling and/or the fixture can be threaded through the hanger ball 12 and the downrod 10, in a conventional manner.

The hanger ball 12 is spherical in shape and has an internal bore 12*a*. Two diametrically opposed slots 12*b* and 12*c* are formed in the hanger ball 12 that extend from the bore and from the upper end of the ball. A groove 12*d* is provided in the upper end portion of the hanger ball 12 to permit access to the ground screw 14.

It will be assumed that the hanger ball 12 is designed to be used with a downrod having a diameter corresponding to the diameter of its bore 12, and that the outer diameter of the downrod 10 is much less than this diameter. Hence if the downrod 10 were directly mounted in the hanger ball 12 it would create an unstable connection due to the above differences in diameters.

To enable the downrod 10 to be supported by the hanger ball 12 in a stable manner, a tubular adapter 20 is provided that extends between the outer diameter of the upper end portion of the downrod 10 and the bore 12*a* of the hanger ball and in a coaxial relation with the downrod and the hanger ball. The length of the adapter 20 is substantially the same as the length of the hanger ball 12, and, as better shown in FIGS. 3 and 4, the outer diameter of the adapter 20 corresponds to the diameter of the bore 12*a* of the hanger ball 12 so that the adapter 20 extends in the latter bore with minimum clearance. Similarly, the bore of the adapter 20 corresponds to the outer diameter of the downrod 10 so that the upper end portion of the downrod extends in the adapter 20 with minimum clearance.

Figure 3:
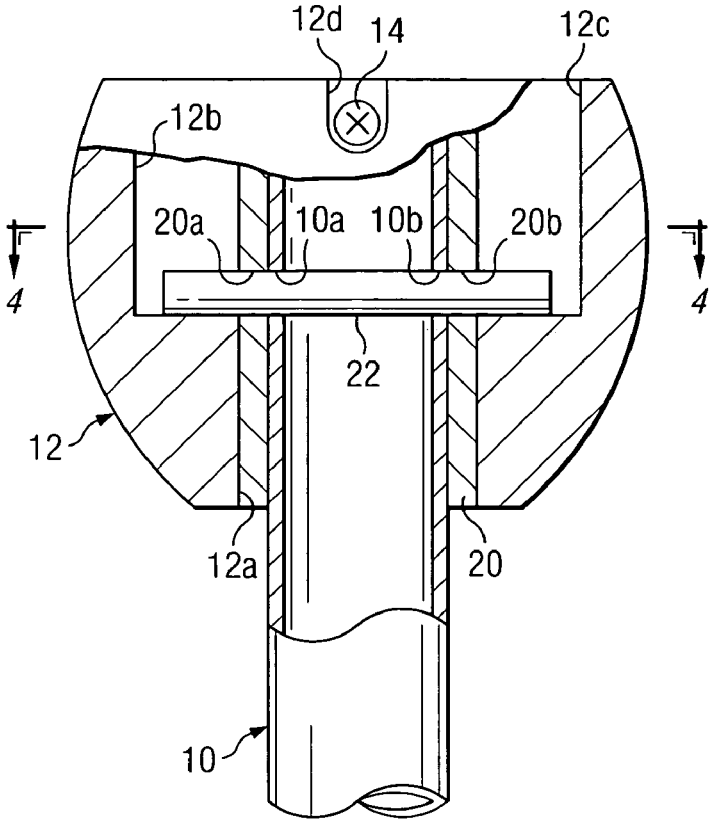
FIG. 3 is a sectional view of the assembly of the embodiment of FIG. 1 in an assembled condition.
Figure 4:
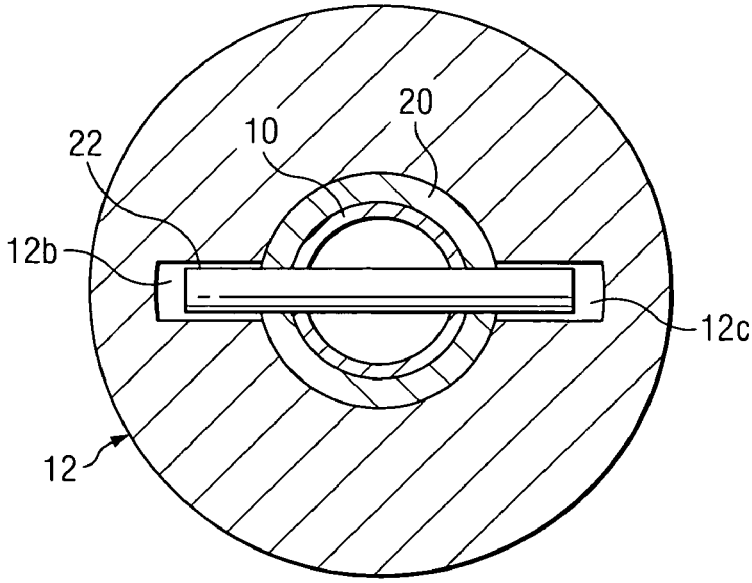
FIG. 4 is a sectional view taken along the line 4—4 of FIG. 2.

The wall of the adapter 20 has two aligned, diametrically opposed, openings 20*a* and 20*b* (FIG. 3) extending therethrough and transverse to the longitudinal axis of the downrod. The openings 20*a* and 20*b* are aligned with the openings 10*a* and 10*b* in the downrod 10, and a pin 22 extends through the aligned openings. The respective end portions of the pin rest on the shoulders of the hanger ball 12 formed by the slots 12*b* and 12*c*, to support, or hang, the downrod 10 from the hanger ball. The axial positions of the openings 20*a* and 20*b* in the wall of the adapter 20 relative to the depth of the slots 12*b* and 12*c* of the hanger ball 12 are such that the upper ends of the downrod 10 and the adapter 20 extend flush with the upper end of the hanger ball 12, as shown in FIG. 3, to enable the hanger ball to be mounted directly to the ceiling.

A groove 20*d* is provided in the upper end portion of the adapter 20 to permit access to the ground screw 14.

As a result, the upper end portion of the downrod 10 is supported along its entire length by the adapter 20, which, in turn, engages the bore 12*a* of the hanger ball with minimum clearance. As a result, the downrod 10 is supported by the hanger ball 12 in a very stable manner.

VARIATIONS

It is understood that several variations may be made in the foregoing without departing from the scope of the invention. For example, the upper end portion of the downrod 12 can be externally threaded and the bore of the hanger ball 12 and the adapter 20 can be internally threaded. Moreover, the grounding screw 14 could be eliminated.

Although only a few exemplary embodiments have been described in detail above, those skilled in the art will readily appreciate that many other variations and modifications are possible in the exemplary embodiment without materially departing from the novel teachings and advantages of this invention. Accordingly, all such variations and modifications are intended to be included within the scope of this invention as defined in the following claims. In the claims, means-plus-function clauses are intended to cover the structures described herein as performing the recited function and not only structural equivalents, but also equivalent structures.

What is claimed is:

1. Apparatus for mounting a downrod to a ceiling, the apparatus comprising:

a hanger ball adapted for connection to the ceiling and having an internal bore and a notch extending through the bore;

a tubular adapter extending in the bore of the hanger ball with minimum clearance and having a bore and two diametrically-opposed openings in its wall;

a tubular downrod having a smooth outer cylindrical surface extending in a corresponding portion of the bore of the adapter with minimum clearance and having two diametrically-opposed openings in its wall in alignment with the openings in the adapter; and a pin extending in the notch and through the aligned openings to connect the downrod to the hanger ball and the adapter.

2. The apparatus of claim 1 wherein the pin and the aligned openings extend transverse to the longitudinal axes of the bores.

3. The apparatus of claim 1 wherein the notch defines two shoulders on which the corresponding end portions of the pin rest.

4. The apparatus of claim 1 wherein the bores of the adapter, the downrod, and the hanger ball extend in a coaxial relationship.

* * * * *